US008293446B2

(12) United States Patent
Wada et al.

(10) Patent No.: US 8,293,446 B2
(45) Date of Patent: Oct. 23, 2012

(54) RESIN-COATED CARRIER METHOD OF MANUFACTURING THE SAME, TWO-COMPONENT DEVELOPER INCLUDING RESIN-COATED CARRIER, DEVELOPING DEVICE AND IMAGE FORMING APPARATUS

(75) Inventors: Osamu Wada, Osaka (JP); Takanori Kamoto, Osaka (JP); Nobuyuki Yoshioka, Osaka (JP); Ayae Nagaoka, Osaka (JP); Tadashi Iwamatsu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 261 days.

(21) Appl. No.: 12/769,121

(22) Filed: Apr. 28, 2010

(65) Prior Publication Data

US 2010/0279221 A1 Nov. 4, 2010

(30) Foreign Application Priority Data

Apr. 30, 2009 (JP) ..... P2009-111575

(51) Int. Cl.
*G03G 9/10* (2006.01)

(52) U.S. Cl. ..... 430/111.4; 430/111.1; 430/111.3; 430/111.32; 430/111.35; 430/137.13; 399/222

(58) Field of Classification Search ..... 430/111.3, 430/111.4, 111.35, 111.32, 137.13, 111.1; 399/222

See application file for complete search history.

(56) References Cited

U.S. PATENT DOCUMENTS

| | | | | |
|---|---|---|---|---|
| 5,108,862 | A | 4/1992 | Kishimoto et al. | |
| 5,512,402 | A | 4/1996 | Okado et al. | |
| 5,998,076 | A * | 12/1999 | Mahabadi et al. | 430/111.32 |
| 2006/0269862 | A1 | 11/2006 | Kobayashi et al. | |
| 2007/0048649 | A1 | 3/2007 | Kobayashi et al. | |
| 2007/0048650 | A1 | 3/2007 | Inoue et al. | |
| 2008/0014514 | A1 | 1/2008 | Kamoto | |
| 2009/0239173 | A1 | 9/2009 | Kobayashi et al. | |

FOREIGN PATENT DOCUMENTS

| | | |
|---|---|---|
| CN | 101105652A A | 1/2008 |
| JP | 2-220068 | 9/1990 |
| JP | 3-192268 | 8/1991 |
| JP | 4-86749 | 3/1992 |

(Continued)

OTHER PUBLICATIONS

U.S. Appl. No. 12/730,583, filed Mar. 24, 2010, entitled "Method for Producing Resin-Coated Carrier, Resin-Coated Carrier, Two-Component Developer, Developing Device, Image Forming Apparatus and Image Forming Method".

*Primary Examiner* — Peter Vajda
(74) *Attorney, Agent, or Firm* — Nixon & Vanderhye P.C.

(57) ABSTRACT

A resin-coated carrier is provided. A resin-coated carrier includes a carrier core and a resin coating layer formed on a surface of the carrier core. The carrier core is composed of a porous material having surface fine pores formed on a surface thereof, and has an apparent density of 1.6 to 2.0 g/cm$^3$. The resin coating layer contains cross-linked fine resin particles. Additionally, the resin-coated carrier is configured such that a volume average particle size of the cross-linked fine resin particles contained in the resin coating layer and an area average diameter of the surface fine pores satisfy a predetermined relational expression.

9 Claims, 2 Drawing Sheets

FOREIGN PATENT DOCUMENTS

| | | | |
|---|---|---|---|
| JP | 7-98521 | | 4/1995 |
| JP | 2006-337579 | | 12/2006 |
| JP | 2007-057943 | | 3/2007 |
| JP | 20007-58124 | A | 3/2007 |
| JP | 2008-65106 | | 3/2008 |
| JP | 2008-209725 | | 9/2008 |
| JP | 2008-224882 | A | 9/2008 |
| JP | 2008-309984 | A | 12/2008 |
| JP | 2009-258595 | | 11/2009 |

* cited by examiner

RESIN-COATED CARRIER METHOD OF MANUFACTURING THE SAME, TWO-COMPONENT DEVELOPER INCLUDING RESIN-COATED CARRIER, DEVELOPING DEVICE AND IMAGE FORMING APPARATUS

CROSS-REFERENCE TO RELATED APPLICATION

This application claims priority to Japanese Patent Application No. 2009-111575, which was filed on Apr. 30, 2009, the contents of which are incorporated herein by reference in its entirety.

BACKGROUND OF THE INVENTION

1. Field of the Invention

The present invention relates to a resin-coated carrier used in electrophotography in which a latent image formed on an image bearing member is developed into a visible image, a method of manufacturing the resin-coated carrier, a two-component developer containing the resin-coated carrier, a developing device using the two-component developer, and an image forming apparatus.

2. Description of the Related Art

Office automation (abbreviated as "OA") equipments have been remarkably developed in these days and in line with such development, there has been a wide spread of copiers, printers, facsimile machines, and the like machines which form images through electrophotography.

For example, an image is formed by way of a charging step, an exposing step, a developing step, a transferring step, a fixing step, and a cleaning step in an image forming apparatus which employs electrophotography. At the charging step, a surface of a photoreceptor serving as an image bearing member is evenly charged in a dark place. At the exposing step, the charged photoreceptor receives signal light derived from a document image, resulting in removal of charges on the exposed part of the photoreceptor whose surface thus bears an electrostatic image (an electrostatic latent image). At the developing step, an electrostatic-image-developing toner (hereinafter simply referred to as "toner" unless otherwise mentioned) is supplied to the electrostatic image on the surface of the photoreceptor, thereby forming a toner image (a visualized image). At the transferring step, the toner image on the surface of the photoreceptor is transferred onto the recording medium by providing the recording medium with charges of which polarity is opposite to that of charges of the toner. At the fixing step, the toner image is fixed on the recording medium by means of heat, pressure, or the like. At the cleaning step, the toner is collected which has not been transferred onto the recording medium and thus remains on the surface of the photoreceptor. Through the above steps, a desired image is formed by the image forming apparatus employing electrophotography.

A usable developer for developing a toner image in the image forming apparatus employing electrophotography includes a one-component developer containing only a toner and a two-component developer containing toner and carrier. The two-component developer is provided with functions of stirring, conveying, and charging toner by the carrier. Accordingly, since toner in two-component developer does not need to have functions of carrier, the two-component developer has characteristics that the controllability is improved due to such separation of the functions, and a high-quality image is easily obtained, compared with one-component developer containing toner solely.

A carrier has two fundamental functions: the function of stably charging a toner to a desired charge level, and the function of conveying a toner to a photoreceptor. Furthermore, a carrier is stirred in a developing tank, and borne onto a magnet roller, on which the carrier forms a magnetic brush. Subsequently, the carrier passes through a regulating blade, and then returns to the inside of the developing tank. This allows the carrier to be reused. In continuing use of the carrier, the carrier is required to stably realize the fundamental functions, particularly the function of stably charge a toner. However, the carrier generally has large density and large stirring torque. Therefore, much driving power is required to stir the carrier in a developing tank.

In recent years, in view of environment, improvement in a carrier relating to low power consumption of an image forming apparatus is developed, and many investigations to decrease a density of the carrier are conducted to achieve low power consumption by reducing stirring torque of a developing tank. Furthermore, a carrier having low density tends to be investigated in the standpoint of long life of a carrier. To realize low density of a carrier, it is important to decrease density of a core material itself of the carrier.

Against such problems, Japanese Unexamined Patent Publication JP-A 2006-337579 and Japanese Unexamined Patent Publication JP-A 2007-57943 disclose a carrier in which a carrier core has voids and a resin is filled in the voids to achieve a low density, and the surface of the carrier core is coated with a silicone resin.

The amount of a resin which is used for coating the carrier core is generally about 2 parts by weight relative to the carrier core, however, the carrier disclosed in JP-A 2006-337579 and JP-A 2007-57943 requires at least 10 parts by weight or more, which is not realistic from the point of view of manufacturing. Specifically, the cost for manufacturing the carrier becomes high by increasing the amount of the resin to be used. Additionally, it is hard to control the thickness of a resin coating film for coating the surface of the carrier core filled with a resin due to a large amount of the resin to be used, and also when a resin capable of sufficiently impregnating the voids of the carrier core is added, carrier particles easily adhere to each other, and it is impossible to form a uniform resin coating film. In this manner, the resin-coated carrier in which thickness of a resin coating layer that is formed on the surface of the carrier core is non-uniform has a non-uniform abrasion ratio of the resin coating layer by stirring in a developing tank, and it is impossible to charge a toner stably.

SUMMARY OF THE INVENTION

Hence, an object of the invention is to provide a resin-coated carrier capable of charging a toner stably on low power consumption even when the number of sheets printed increases by preventing the thickness of a resin coating layer that is formed on a surface of the carrier core composed of a porous material, from being non-uniform and a method of manufacturing the same. Additionally, another object of the invention is to provide a two-component developer containing the resin-coated carrier, a developing device using the two-component developer and an image forming apparatus.

The invention provides a resin-coated carrier comprising:

a carrier core composed of a porous material having fine pores formed on a surface thereof, and having an apparent density of 1.6 to 2.0 g/cm$^3$; and a resin coating layer formed on a surface of the carrier core, containing cross-linked fine resin particles, the resin-coated carrier satisfying the following expression (1):

$$(Db+0.3\ \mu m)>Da>Db \quad (1),$$

wherein Da (μm) represents a volume average particle size of the cross-linked fine resin particles and Db (μm) represents an area average diameter of the fine pores.

According to the invention, the resin-coated carrier comprises a carrier core and a resin coating layer formed on a surface of the carrier core. The carrier core is composed of a porous material having fine pores formed on a surface thereof, and has an apparent density of 1.6 to 2.0 g/cm$^3$. The resin coating layer contains cross-linked fine resin particles. Further, the resin-coated carrier, since the volume average particle size of the cross-linked fine resin particles and the area average diameter of the fine pores formed on the surface of the carrier core satisfy the expression (1), becomes the one having fine pores which are filled with the cross-linked fine resin particle. Therefore, it is possible to prevent a resin constituting the resin coating layer from moving and being impregnated to a void of the inside of the carrier core of the porous material and being impregnated. Accordingly, the resin coating layer whose thickness is uniform formed on the surface of the carrier core in which the fine pores that are formed on the surface thereof are filled with the cross-linked fine resin particle, and it is possible to obtain the resin-coated carrier capable of charging the toner stably on low power consumption even when the number of sheets printed increases.

Additionally, in the invention, it is preferable that the resin coating layer contains a conductive particle.

According to the invention, the resin coating layer contains a conductive particle. The resin-coated carrier thereby becomes to the one having improved charge providing characteristics to the toner.

Further, in the invention, it is preferable that the resin-coated carrier has a volume average particle size of 25 to 50 μm.

According to the invention, the resin-coated carrier has a volume average particle size of 25 to 50 μm. The resin-coated carrier whose volume average particle size is 25 μm or more has less carrier attachment which is phenomenon that a carrier itself adheres to an image bearing member on which an electrostatic latent image is to be formed, and it is possible to prevent the reduction in the image quality. Further, the resin-coated carrier whose volume average particle size is 50 μm or less has a high toner retention capability, and is able to prevent degradation of graininess of formed images with the toner. Accordingly, the resin-coated carrier whose volume average particle size is 25 to 50 μm is able to form a high-resolution and high-quality image.

Further, in the invention, it is preferable that a silicone fine resin particle is used as the cross-linked fine resin particle.

According to the invention, it is possible to stabilize the capability of charging the toner over a long period of use without changing a charging performance largely to the resin coating layer formed on the surface of the carrier core by using the silicone fine resin particle as a cross-linked fine resin particle.

Further, in the invention, it is preferable that a ratio of a total projected area of the cross-linked fine resin particles relative to a total surface area of the carrier core ((total projected area of the cross-linked fine resin particles/total surface area of the carrier core)×100) is 10 to 30%.

According to the invention, since it is possible to fill the fine pores of the carrier core and to suppress aggregation of fine resin particles by causing the ratio of the total projected area of the cross-linked fine resin particles relative to the total surface area of the carrier core ((total projected area of the cross-linked fine resin particles/total surface area of the carrier core)×100) to be 10 to 30%, the resin coating layer is able to be formed uniformly on the surface of the carrier core.

Further, the invention provides a method of manufacturing the resin-coated carrier mentioned above comprising:

cross-linked fine resin particle adding step of adhering the cross-linked fine resin particles to a surface of the carrier core composed of the porous material having fine pores formed on a surface thereof and having an apparent density of 1.6 to 2.0 g/cm$^3$;

a coating step of forming the resin coating layer over the carrier core and the cross-linked fine resin particles adhered to the surface of the carrier core which are incorporated at the cross-linked fine resin particle adding step, and the carrier core and the cross-linked fine resin particles used at the cross-linked fine resin particle adding step satisfying the expression (1):

$$(Db+0.3\ \mu m)>Da>Db \quad (1),$$

wherein Da(μm) represents a volume average particle size of the cross-linked fine resin particles, and Db (μm) represents an area average diameter of the fine pores.

According to the invention, the method of manufacturing the resin-coated carrier comprises the cross-linked fine resin particle adding step and the coating step. At the cross-linked fine resin particle adding step, the cross-linked fine resin particles are caused to be adhered to the surface of the carrier core. Consequently, at the coating step, the resin coating layer is formed over the carrier core and the cross-linked fine resin particles adhered to the surface of the carrier core. Here, at the cross-linked fine resin particle adding step, since the cross-linked fine resin particles and the carrier core which satisfy the expression (1) are used, it is possible to obtain the carrier core having fine pores which are formed on the surface thereof and are filled with the cross-linked fine resin particles. Further, the resin coating layer is formed on the carrier core having fine pores which are formed on the surface thereof and are filled with the cross-linked fine resin particles so that it is possible to obtain the resin-coated carrier in which the resin coating layer having uniform thickness is formed on a surface of the carrier core. Thereby it is possible to obtain the resin-coated carrier capable of charging the toner stably at low power consumption even when the number of sheets printed increases.

The invention provides a two-component developer comprising the resin-coated carrier mentioned above and a toner containing a binder resin and a colorant.

According to the invention, the two-component developer comprises the resin-coated carrier of the invention and a toner containing a binder resin and a colorant. The resin-coated carrier according to the invention can give stabilized charge amount to a toner, and thereby a two-component developer having stabilized charge amount even though the number of printing is increased can be formed. Use of such a two-component developer can stably form a high quality image that can finely reproduce an image, has good color reproducibility and high image density and is free of image defects such as fog over a long period of time.

Additionally, the invention provides a developing device performing development using the two-component developer mentioned above.

According to the invention, the developing device performs development using the two-component developer according to the invention. As a result, the development can be performed with a toner having stabilized charge amount even though the number of printing is increased, and a toner image having high definition and free of fog can stably be formed over a long period of time.

Further, the invention provides an image forming apparatus comprising the developing device mentioned above.

According to the invention, the image forming apparatus comprises the developing device. The developing device according to the invention can stably form a toner image with high definition and free of fog over a long period of time. Therefore, even in the image forming apparatus, a high quality image that finely reproduces an image, has good color reproducibility and high image density and is free of image defects such as fog can stably be formed over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
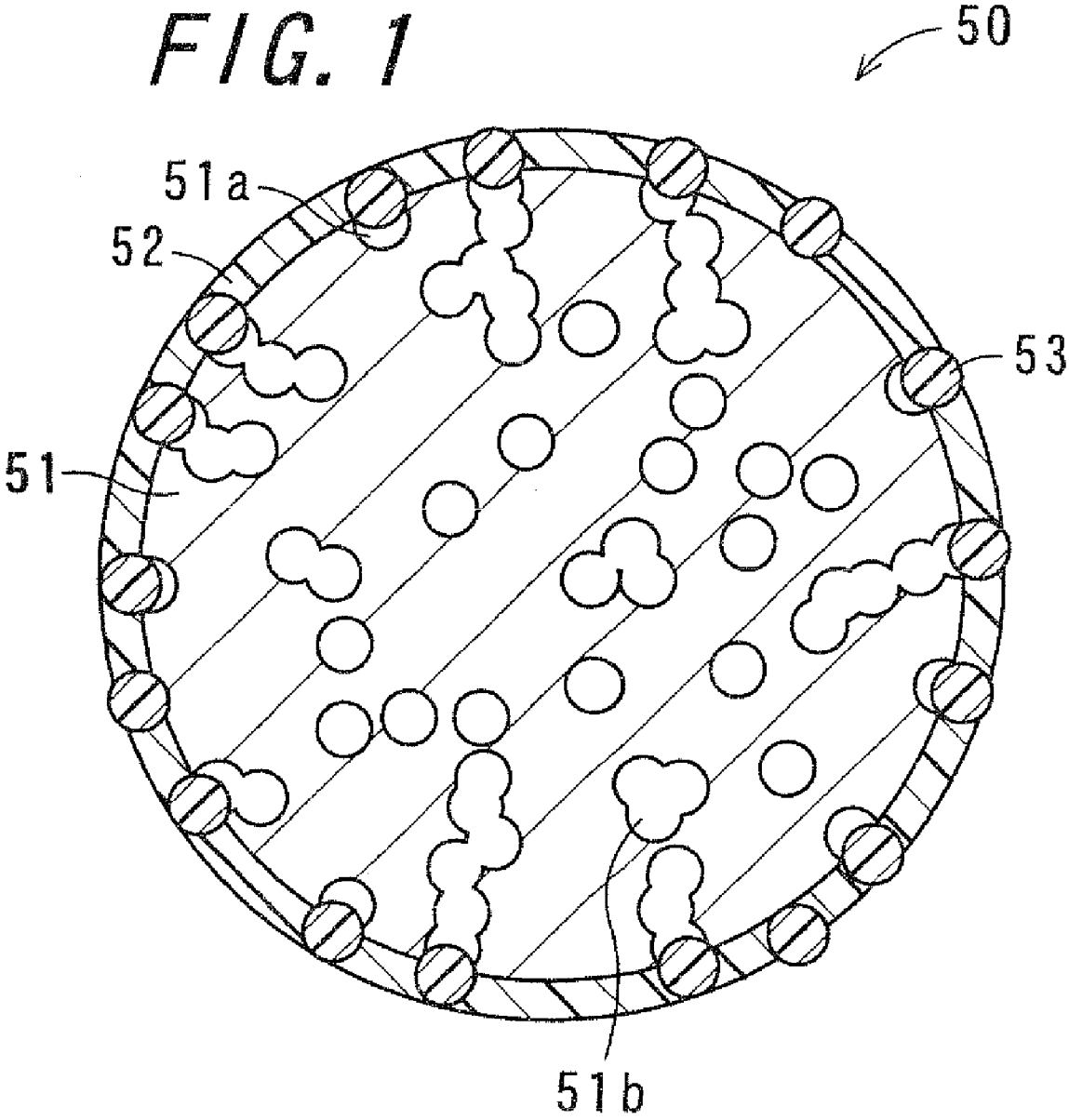
FIG. 1 is a view showing a structure of a resin-coated carrier according to one embodiment of the invention.

Now referring to the drawings, preferred embodiments the invention are described below.

1. Resin-Coated Carrier

FIG. 1 is a view showing a structure of a resin-coated carrier 50 according to one embodiment of the invention. The resin-coated carrier 50 is to be used for an electrophotographic developer for developing an electrostatic latent image formed on a photoreceptor as an image bearing member into a visible image, and includes two basic functions of a function of charging the toner stably to a desired charge amount and a function of conveying the toner to the photoreceptor. The resin-coated carrier 50 includes a carrier core 51 and a resin coating layer 52 formed on the surface of the carrier core 51.

(1) Carrier Core

The carrier core 51 constituting the resin-coated carrier 50 of the present embodiment is comprised of the porous material in which voids 51*b* are formed inside thereof and fine pores 51*a* are formed on a surface thereof, and has the apparent density of 1.6 to 2.0 g/cm$^3$. In the resin-coated carrier 50 of the embodiment, openings of the fine pores 51*a* which are formed on the surface of the carrier core 51 (hereinafter, referred to as "surface fine pores 51*a*") are filled with cross-linked fine resin particles 53 contained in the resin coating layer 52 described below.

For the resin-coated carrier 50 including the carrier core 51 having the apparent density of 2.0 g/cm$^3$ or less, at the time of stirring, it is possible to achieve power saving because driving torque of a magnet roller and the like in the inside of the developing tank is able to be reduced. Further, although the toner and the resin-coated carrier 50 are stirred inside the developing tank all the time at the time of developing, since stirring stress applied to the resin-coated carrier 50 and abrasion of the resin coating layer 52 are reduced when the apparent density is sufficiently small, it is possible to make the resin-coated carrier 50 impart a charge amount stably to the toner even when the number of sheets printed increases. Additionally, the carrier core 51 having the apparent density of 1.6 g/cm$^3$ or more has the surface fine pores 51*a* whose area average diameter does not become too large, thus it is possible to achieve the resin-coated carrier 50 to have the surface fine pore 51*a* filled sufficiently with the cross-linked fine resin particle 53 contained in the resin coating layer 52.

In the resin-coated carrier 50 of the embodiment, the surface fine pores 51*a* of the carrier core 51 are formed such that a ratio of the total area thereof relative to the total surface area of the carrier core 51 is 5 to 30%. Additionally, the surface fine pores 51*a* are formed such that the area average diameter thereof is 0.3 to 1.0 μm. When the area ratio of the surface fine pores 51*a* is less than 5%, it is impossible to achieve the carrier core 51 whose apparent density is sufficiently small. Further, when the area ratio of the surface fine pores 51*a* exceeds 30% or the area average diameter thereof exceeds 1 μm, it is impossible to achieve the resin-coated carrier 50 to have the surface fine pores 51*a* filled sufficiently with silicone fine resin particles 53 contained in the resin coating layer 52.

Here, the area average diameter of the surface fine pores 51*a* is an equivalent circle diameter in which area percentage of the accumulated area relative to the total surface fine pores is 50% in accumulated area distribution where the surface fine pores 51*a* formed on the surface of the carrier core 51 are integrated from a small diameter side. As the carrier core 51, it is possible to use what is often used in this field, and for example, a magnetic metal such as iron, copper, nickel and cobalt, and a magnetic oxide such as ferrite and magnetite.

Ferrite as magnetic oxide is generally a group of iron oxides having the component of $MO.Fe_2O_3$. M includes divalent metal ions such as $Fe^{2+}$, $Mn^{2+}$, $Mg^{2+}$, $Co^{2+}$, $Ni^{2+}$, $Cu^{2+}$ and $Zn^{2+}$. The ferrite is obtained by mixing a powder of a metal oxide containing those divalent metal ions and a powder of iron oxide, compression forming the mixture, and firing the resulting molded article. The metal oxides may be used each alone, or two or more of them may be used in combination. When the metal oxide has a mixed component, controllable range of magnetic characteristics in the carrier core 51 broadens.

When raw material of M is a metal oxide containing Fe2+, Fe2O3 is preferred. When raw material of M is a metal oxide containing $Mn^{2+}$, $MnCO_3$ is preferred, but $Mn_3O_4$ and the like may be used. When raw material of M is a metal oxide containing $Mg^{2+}$, $MgCO_3$ and $Mg(OH)_2$ are preferred.

The ferrite includes soft ferrite showing soft magnetic properties and hard ferrite showing hard magnetic properties. In the embodiment, the magnetic oxide is preferably soft ferrite. Because hard ferrite is a magnet, the remanent magnetization is large. Where the magnetic oxide is hard ferrite, there are possibilities that resin-coated carrier particles adhere to each other, thereby decreasing fluidity of the developer, and the resin-coated carrier 50 is difficult to separate from a magnet roller. However, when the magnetic oxide is soft ferrite, the remanent magnetization can be decreased to 10 emu/g or less, the resin-coated carrier 50 which has good fluidity of the developer and is easy to separate from a magnet roller and the like can be obtained.

(2) Resin Coating Layer

The resin coating layer 52 is a layer formed such that a resin coating composition covers the surface of the carrier core 51, and contains the cross-linked fine resin particles 53. The cross-linked fine resin particle 53 includes a silicone fine resin particle, a melamine fine resin particle, a benzoguanamine fine resin particle, an amorphous silica fine particle and the like, however, is preferably a silicone fine resin particle. By using a silicone fine resin particle as the cross-linked fine resin particle 53, it is possible to make the resin-coated carrier 50 stably having the capability of charging the toner over a long period of use without changing a charging capability largely to the resin coating layer 52 formed on the surface of the carrier core 51. The resin coating composition constituting the resin coating layer 52 is a mixture mixed with one or two or more of additives chosen from a cross-linked silicone resin, and as required, a conductive particle, an amino-group-containing silane coupling agent, a resin other than the silicone resin, bifunctional silicone oil and the like.

The cross-linked fine resin particles 53 contained in the resin coating layer 52 satisfy the following expression (1), and are configured so as to fill the surface fine pores 51*a* of the carrier core 51:

$$(Db+0.3\ \mu m)>Da>Db \quad (1),$$

wherein Da represents the volume average particle size of the cross-linked fine resin particles 53, and Db represents the area average diameter of the surface fine pores 51*a* of the carrier core 51.

At this time, in the resin-coated carrier 50, the cross-linked fine resin particle 53 fills the surface fine pore 51*a* of the carrier core 51 so that a ratio P1 of the total area of the opened surface fine pores 51*a* (surface fine pores without being filled with the cross-linked fine resin particles) after adding the cross-linked fine resin particle 53 relative to the total surface area of the carrier core 51 ((total area of the opened surface fine pore 51*a* after adding the cross-linked fine resin particle 53/total surface area of the carrier core)×100) is 0 to 5%.

When the ratio P1 (hereinafter, referred to as "opened surface fine pore ratio P1") exceeds 5%, the resin-coated carrier 50 is not able to have the surface fine pores 51*a* sufficiently filled with the cross-linked fine resin particles 53.

Note that, the opened surface fine pore ratio P1 is calculated as follows. First, photographs of the carrier core 51 before and after adding the cross-linked fine resin particles 53 are taken with an electron microscope (trade name: VE-9500, manufactured by Keyence Corporation) of 1000 times power. A ½ region of radius of the carrier core 51 from the center of the carrier core 51 is then trimmed away from the respective photographs, and the total area of the surface fine pores and the area average diameter of the carrier core 51 are calculated by extracting and analyzing perimeters of the surface fine pores 51*a* of the carrier core 51 from a region thereof with image analysis software (trade name: A-ZO KUN, manufactured by Asahi Kasei Engineering Corporation). Such analysis is performed for each 50 particles for the carrier core 51 before and after adding the cross-linked fine resin particle 53, and the average value serves as the total area of the surface fine pore and the area average diameter of the carrier core 51. Consequently, the area of the trimmed region serves as the total surface area of the carrier core 51, then the opened surface fine pore ratio P1 is calculated.

Additionally, for the resin-coated carrier 50, it is preferable that the cross-linked fine resin particles 53 are added in the resin coating layer 52 so that a ratio P2 of the total projected area of the cross-linked fine resin particles 53 (the projected area sum of the total cross-linked fine resin particles) relative to the total surface area of the carrier core 51 ((total projected area of the cross-linked fine resin particles/total surface area of the carrier core)×100) is 10 to 30%. When the ratio P2 (hereinafter, referred to as "fine resin particle additive ratio P2") is less than 10%, the resin-coated carrier 50 is not able to have the surface fine pores 51*a* sufficiently filled with the cross-linked fine resin particles 53. Further, when the fine resin particle additive ratio P2 exceeds 30%, aggregation of the cross-linked fine resin particles 53 is increased, and the uniformity of the resin coating layer 52 gets worse.

Note that, the fine resin particle additive ratio P2 is calculated as follows. First, a surface area (or a projected area) for one particle is calculated from radius of the cross-linked fine resin particle 53 (½ of the volume average particle size). Further, the number of the added cross-linked fine resin particles 53 relative to the carrier core 51 is calculated from the radii of the cross-linked fine resin particles 53, the apparent density of the carrier core 51 and an added weight of the cross-linked fine resin particle 53. Then, by using the surface area for one particle of the cross-linked fine resin particles 53 and the number of the added cross-linked fine resin particles 53 calculated as mentioned above, the total projected area of the cross-linked fine resin particle is calculated, further, the fine resin particle additive ratio P2 is calculated by using the calculated result.

As mentioned above, since the cross-linked fine resin particles 53 contained in the resin coating layer 52 are constituted so as to satisfy the expression (1) and fill the surface fine pores 51*a* of the carrier core 51, it is possible to prevent a resin in the resin coating composition constituting the resin coating layer 52 from being impregnated by moving to the voids 51*b* inside the carrier core 51 of the porous material. Therefore, the thickness of the resin coating layer 52 formed on the surface of the carrier core 51 is prevented from being non-uniform, the abrasion ratio of the resin coating layer 52 by stirring in the developing tank is uniform and it is possible to make the resin-coated carrier 50 stably having the capability of charging the toner.

The volume average particle size Da of the cross-linked fine resin particles 53 is set to 0.3 to 1.0 μm. When the volume average particle size Da of the cross-linked fine resin particles 53 is less than 0.3 μm, the resin-coated carrier 50 is not able to have the surface fine pores 51*a* sufficiently filled with the cross-linked fine resin particles 53. Additionally, when the volume average particle size Da of the cross-linked fine resin particles 53 exceeds 1.0 μm, the aggregation of the cross-linked fine resin particles 53 is increased, and the uniformity of the resin coating layer 52 gets worse.

Further, the resin coating layer 52 may contain a conductive particle as a conductive material. Thereby, the resin-coated carrier 50 has the improved charge providing characteristics to the toner. As the conductive particle, for example, an oxide such as a conductive carbon black, a conductive titanic oxide and a tin oxide is used. A carbon black is preferable for developing conductivity in a small addition amount, however, there are some cases where carbon detachment from the resin coating layer 52 of the resin-coated carrier 50 for a color toner is concerned. In this case, the conductive titanic oxide which is doped with antimony and the like is preferable.

(3) Resin-Coated Carrier

It is preferable that the resin-coated carrier 50 in which the resin coating layer 52 is formed on the surface of the carrier core 51 has the volume average particle size of 25 to 50 μm. The resin-coated carrier 50 having the volume average particle size of 25 μm or more has less carrier attachment which is a phenomenon that a carrier itself adheres to the image bearing member in which the electrostatic latent image is formed, and it is possible to prevent the reduction in the image quality. Further, the resin-coated carrier 50 having the volume average particle size of 50 μm or less has a high toner retention capability, and is able to prevent degradation of graininess of formed images with the toner. Therefore, the resin-coated carrier 50 having the volume average particle size of 25 to 50 μm is able to form a high-resolution and high-quality image.

Additionally, the resin-coated carrier 50 of the embodiment has the voids 51*b* which is formed inside the carrier core 51 without being filled with a resin. Therefore, it is possible to reduce the resin amount to be used in manufacturing compared with the resin-coated carrier 50 with the voids 51*b* filled with a resin, and adherence of carrier particles caused by a large amount of resin to be used in manufacturing is able to be suppressed. Further, the manufacturing cost is able to be inexpensive.

(4) Method of Manufacturing Resin-Coated Carrier

A method of manufacturing the resin-coated carrier 50 includes a weighing step, a mixing step, a pulverization step, a granulation step, a calcination step, a firing step, a crushing step, a classification step, a cross-linked fine resin particle adding step, and a coating step.

[Weighing Step and Mixing Step]

At these steps, raw materials of a carrier core 51, such as magnetic oxide, are weighed, and mixed to obtain a metal raw mixture. In the case of using two kinds or more of magnetic oxides, those magnetic oxides are weighed such that blending ratio of two kinds or more of magnetic oxides matches the desired component of magnetic oxide.

Then, resin particles are added to the metal raw material mixture. The resin particles added include carbon-based resin particles such as polyethylene and acrylic resin, and resin particles containing silicone such as silicone resin (hereinafter referred to as "silicone-based resin particles"). The carbon-based resin particles and the silicone-based resin particles are the same in that those particles are burned at the calcination step described hereinafter, and a hollow structure is formed in a calcined powder by a gas generated during burning. The carbon-based resin particles merely form a hollow structure during calcination, but the silicone-based resin particles become $SiO_2$ after burning, and remain in a hollow structure formed.

The volume average particle size of the resin particles is preferably 2 to 8 μm. Further, the addition amount of the resin particles is preferably 0.1 to 20 wt % based on the total amount of raw materials of the carrier core 51. Here, by adjusting the addition amount of the resin particles, it is possible to control the area average diameter of the surface fine pores 51*a* formed in the carrier core 51 to be obtained, and the area ratio relative to the total surface area of the carrier core 51.

[Pulverization Step]

At this step, the metal raw material mixture and the resin particles are introduced into a pulverizer such as a vibration mill, and are pulverized to a volume average particle size of from 0.5 to 2.0 μm, and preferably 1 μm. Then, water, 0.5 to 2 wt % of a binder and 0.5 to 2 wt % of a dispersant are added to the pulverized material to form a slurry having a solid content concentration of from 50 to 90 wt %. The slurry is wet-pulverized with a ball mill or the like. The binder used here is preferably polyvinyl alcohol, and the dispersant used here is preferably ammonium polycarbonate.

[Granulation Step]

At this step, the slurry wet-pulverized is introduced into a spraying drier, and sprayed in hot air of 100 to 300° C. to dry the slurry. Thus, a granulated powder having a volume average particle size of from 10 to 200 μm is obtained. Considering a volume average particle size of the resin-coated carrier 50 manufactured by the present manufacturing method, the particle size of the granulated powder obtained is controlled by removing coarse particles and fine particles outside the above range of the volume average particle size by a vibration sieve. Specifically, since the volume average particle size of the resin-coated carrier 50 is preferably 25 μm or more and 50 μm or less, it is preferred that the volume average particle size of the granulated powder is controlled to 15 to 100 μm.

[Calcination Step]

At this step, the granulated powder is introduced into a furnace heated to from 800° C. to 1000° C., and calcined in the atmosphere to obtain a calcined product. In this case, a hollow structure is formed in the granulated powder by a gas generated by burning the resin particles. In the case where the silicone-based resin particles are used as the resin particles, $SiO_2$ which is non-magnetic oxide is formed in the hollow structure.

[Firing Step]

At this step, the calcined product having the hollow structure formed therein is introduced into a furnace heated to 1100 to 1250° C. and burned to form ferrite. Thus, a fired product is obtained. Where the temperature at the time of the firing is high, oxidation of iron proceeds and magnetic force is decreased. Therefore, the remanent magnetization of the carrier core 51 can be adjusted by, for example, firing temperature. Atmosphere during the firing is appropriately selected depending on the kind of metal raw materials such as magnetic oxide, of raw materials of the carrier core. For example, in the case where the metal raw materials are Fe and Mn (molar ratio: 100:0 to 50:50), nitrogen atmosphere is required. In the case where the metal raw materials are Fe, Mn and Mg, nitrogen atmosphere and oxygen partial pressure controlled atmosphere are preferred. In the case where the metal raw materials are Fe, Mn and Mg and the molar ratio of Mg exceeds 30%, air atmosphere may be used.

[Crushing Step and Classification Step]

At these steps, the fired product obtained at the firing step is coarsely crushed with hammer mill crushing or the like, and then subjected to primary classification with an air classifier. Further, after making a particle size uniform with a vibration sieve or an ultrasonic wave sieve, the particles are put in a magnetic field concentrator to remove a non-magnetic component. Thus, a carrier core 51 having the voids 51*b* thereinside and the surface pores 51*a* formed on the surface thereof is obtained.

[Cross-Linked Fine Resin Particle Adding Step]

At this step, the carrier core 51 obtained at the classifying step is immersed in cross-linked fine resin particle dispersion liquid which is made by dispersing the cross-linked fine resin particles 53 in an organic solvent, and is heated (temperature: 80 to 100° C.) while stirring. Here, the organic solvent is not particularly limited as long as a solvent which does not dissolve the cross-linked fine resin particle 53, and for example, includes toluene or the like.

Further, the cross-linked fine resin particle 53 that is added in the organic solvent is selected from those whose volume average particle size Da satisfies the above expression (1).

Note that, by adjusting the addition amount of the resin particles at the mixing step after measuring in advance the volume average particle size Da of the cross-linked fine resin particle 53 that is added in the organic solvent, the area average diameter Db of the surface fine pores 51*a* formed in the carrier core 51 may be controlled to satisfy the above expression (1).

Thereafter, the cross-linked fine resin particle 53 is adhered to the surface of the carrier core 51 by volatile removal of the organic solvent, and the carrier core 51 with the surface fine pore 51*a* filled with the cross-linked fine resin particle 53 is obtained.

At this time, the opened surface fine pore ratio P1 is able to be controlled by adjusting the addition amount of the cross-linked fine resin particles that are added in the cross-linked fine resin particle dispersion liquid.

[Coating Step]

At this step, the carrier core 51 obtained at the cross-linked fine resin particle adding step and whose surface fine pore 51*a* is filled with the cross-linked fine resin particle 53 is coated with a coating resin solution which is made by dissolving the resin coating composition in the organic solvent such as toluene to form the resin coating layer 52 on the surface of the carrier core 51, thereafter the resin-coated carrier 50 is obtained by volatile removal of the organic solvent.

In the resin-coated carrier 50 obtained in this manner, the resin does not enter the voids 51*b* of the carrier core 51. The size of the voids 51*b* is around 0.7 μm, and the resin needs to penetrate by capillary action so that the resin enters the carrier core 51 having the voids 51*b* of such size, however, in the embodiment, the resin does not enter the voids 51*b* formed inside the carrier core 51 since the surface fine pores 51*a* of the carrier core 51 are filled with the silicone fine resin particles 53.

2. Two-Component Developer

The two-component developer is configured by the above-mentioned resin-coated carrier 50, and the toner containing a binder resin and a colorant. The resin-coated carrier 50 is able to impart a stable charge amount to the toner, thus the two-component developer is able to have a stable charge amount even when the number of sheets printed increases. The use of such two-component developer results in stable formation over a long period of time of a high-quality image which has high-resolution image reproduction, favorable color reproduction, high image density and no image defects such as a fog.

(1) Toner

The toner includes a toner base particle, and the toner base particle contains a binder resin and a colorant as essential components, and in addition thereto, includes a charge control agent, a release agent and the like. Additionally, the toner contains two or more of external additives whose particle sizes are different from each other.

(Binder Resin)

The binder resin is not particularly restricted, and a known binder resin for black toner or color toner is usable. Examples thereof include a polyester resin, a styrene resin such as polystyrene and a styrene-acrylic acid ester copolymer resin, an acrylic resin such as polymethylmethacrylate, a polyolefin resin such as polyethylene, polyurethane, and an epoxy resin. In addition, a resin obtained by polymerization reaction by mixture of a monomer mixture material and a release agent may be used. The binder resins may be used each alone, or two or more of them may be used in combination.

In a case of using the polyester resin as the binder resin, examples of the aromatic alcohol ingredient required for obtaining the polyester resin include bisphenol A, polyoxyethylene-(2.2)-2,2-bis(4-hydroxyphenyl)propane, polyoxyethylene-(2.0)-2,2-bis(4-hydroxyphenyl)propane, polyoxypropylene-(2.0)-2,2-bis(4-hydroxyphenyl)propane, polyoxypropylene-(2.2)-polyoxyethylene-(2.0),-2,2-bis(4-hydroxyphenyl)propane, polyoxypropylene-6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane, and derivatives thereof.

Further, examples of the polybasic acid ingredient in the polyester resin include dibasic acids such as succinic acid, adipic acid, sebasic acid, azelaic acid, dodecenyl succinic acid, n-dodecyl succinic acid, malonic acid, maleic acid, fumaric acid, citraconic acid, itaconic acid, glutaconic acid, cyclohexane dicarboxylic acid, orthophthalic acid, isophthalic acid, and terephthalic acid, tri- or higher basic acids such as trimellitic acid, trimethinic acid, and pyromellitic acid, as well as anhydrides and lower alkyl esters thereof. With a view point of heat resistant cohesion, terephthalic acid or lower alkyl esters thereof are preferred.

Here, the acid value of the polyester resin constituting the toner is preferably from 5 to 30 mgKOH/g. In a case where the acid value is less than 5 mgKOH/g, the charging characteristic of the resin is lowered, and the organic bentonite as the charge controller is less dispersible in the polyester resin. They give undesired effects on the rising of the charged amount and the stability of the charged amount by repetitive development in continuous use. Accordingly, the above-mentioned range is preferable.

(Colorant)

As a colorant, various kinds of colorants are usable in accordance with a desired color; for example, a yellow toner colorant, a magenta toner colorant, a cyan toner colorant, a black toner colorant and the like.

As a yellow toner colorant, examples thereof include, in reference to the color index classification, an azo dye such as C. I. Pigment Yellow 1, C. I. Pigment Yellow 5, C. I. Pigment Yellow 12, C. I. Pigment Yellow 15 and C. I. Pigment Yellow 17, an inorganic pigment such as a yellow iron oxide or an ocher, a nitro dye such as C. I. Acid Yellow 1, an oil soluble dye such as C. I. Solvent Yellow 2, C. I. Solvent Yellow 6, C. I. Solvent Yellow 14, C. I. Solvent Yellow 15, C. I. Solvent Yellow 19 or C. I. Solvent Yellow 21.

As a magenta toner colorant, examples thereof include, in reference to the color index classification, C. I. Pigment Red 49, C. I. Pigment Red 57, C. I. Pigment Red 81, C. I. Pigment Red 122, C. I. Solvent Red 19, C. I. Solvent Red 49, C. I. Solvent Red 52, C. I. Basic Red 10 and C. I. Disperse Red 15.

As a cyan toner colorant, examples thereof include, in reference to the color index classification, C. I. Pigment Blue 15, C. I. Pigment Blue 16, C. I. Solvent Blue 55, C. I. Solvent Blue 70, C. I. Direct Blue 25 and C. I. Direct Blue 86.

As a black toner colorant, examples thereof include carbon blacks such as channel black, roller black, disk black, gas furnace black, oil furnace black, thermal black, and acetylene black. The carbon black may be selected properly from among various kinds of carbon blacks mentioned above according to a target design characteristic of toner.

In addition to these pigments, a bright red pigment, a green pigment and the like are also usable as a colorant. The colorants may be used each alone, or two or more of them may be used in combination. Further, two or more of the similar color series are usable, or one of or two or more of the different color series are also usable.

The colorant may be used in the form of a masterbatch. The masterbatch of the colorant can be produced in the same manner as a general masterbatch. For example, a melted synthetic resin and a colorant are kneaded so that the colorant is uniformly dispersed in the synthetic resin, then the resultant mixture thus melt-kneaded is granulated to produce a masterbatch. For the synthetic resin, the same kind as the binder resin of the toner, or a synthetic resin having excellent compatibility with the binder resin of the toner is used. At this time, a ratio of the synthetic resin and the colorant to be used is not particularly restricted, but preferably 30 to 100 parts by weight based on 100 parts by weight of the synthetic resin. Further, the masterbatch is granulated so as to have a particle size of about 2 to 3 mm.

Further, the amount of a colorant to be used is not particularly restricted, but preferably 5 to 20 parts by weight based on 100 parts by weight of the binder resin. This amount does not refer to the amount of the masterbatch, but to the amount of the colorant itself included in the masterbatch. By using a colorant within such a range, it is possible to form a high-density and extremely high-quality image without damaging various physical properties of the toner.

(Charge Control Agent)

The charge control agent is added for the purpose of controlling frictional electrification characteristic of the toner. The charge control agent is selected from a charge control agent for controlling positive charges and a charge control agent for controlling negative charges, which are commonly used in this field. Examples of the charge control agent for controlling positive charges include a basic dye, quaternary ammonium salt, quaternary phosphonium salt, aminopyrine, a pyrimidine compound, a polynuclear polyamine compound, aminosilane, a nigrosine dye, a derivative thereof, a triphenylmethane derivative, guanidine salt, and amidine salt.

Examples of the charge control agent for controlling negative charges include oil-soluble dyes such as oil black and spiron black, a metal-containing azo compound, an azo complex dye, metal salt naphthenate, metal complex and metal salt of a salicylic acid and a derivative thereof (wherein the metal is chrome, zinc, zirconium, or the like), a boron compound, a fatty acid soap, long-chain alkylcarboxylic acid salt, and a resin acid soap. Among them, the boron compound is particularly preferable because it contains no heavy metal.

The charge control agent for controlling positive charges and the charge control agent for controlling negative charges can be used according to their intended applications. The charge control agents may be used each alone, or two or more of them may be used in combination as necessary. A usage of the charge control agent is not limited to a particular level and may be selected as appropriate from a wide range. A preferable usage of the charge control agent is 0.5 to 3 parts by weight based on 100 parts by weight of the binder resin.

(Release Agent)

The release agent can use the one commonly used in this field, and examples thereof include a petroleum wax such as a paraffin wax and a derivative thereof; a microcrystalline wax and a derivative thereof; a hydrocarbon synthetic wax such as a Fischer-Tropsch wax and a derivative thereof; a polyolefin wax and a derivative thereof; a low-molecular-weight polypropylene wax and a derivative thereof; a polyolefin polymer wax (a low-molecular-weight polyethylene wax and the like) and a derivative thereof; a botanical wax such as a carnauba wax and a derivative thereof; a rice wax and a derivative thereof; a candelilla wax and a derivative thereof; a plant wax such as a Japan wax; an animal wax such as a beeswax and a spermaceti wax; a synthetic wax of fat and oil such as a fatty acid amide and a phenol fatty acid ester; a long-chain carboxylic acid and a derivative thereof; a long-chain alcohol and a derivative thereof; a silicone polymer; and a higher fatty acid. Note that examples of the derivatives include an oxide, a vinyl monomer-wax block copolymer and a vinyl monomer-wax graft modified material. The amount of the release agent to be used is not particularly restricted and is appropriately selectable from a wide range, but preferably 0.2 to 20 parts by weight based on 100 parts by weight of the binder resin.

(External Additive)

The external additive of the toner can use the one commonly used in the field, and examples thereof include a silicon oxide, a titanic oxide, a silicon carbide, an aluminum oxide and a barium titanate. According to the embodiment, as the external additive, two or more of external additives having different particle sizes are used in combination, and at least one of the external additives has a volume average particle size of a primary particle size of 0.1 μm to 0.2 μm. By using the external additive in which at least one of the external additives has a primary particle size of 0.1 μm to 0.2 μm, it is possible to improve transfer property particularly with respect to, in particular, color toner, and to stably charge the toner over a long period of time, without causing decrease in chargeability due to adhesion of the external additive to the surface of the carrier. The amount of the external additive to be used is not particularly restricted, but preferably 0.1 to 3.0 parts by weight based on 100 parts by weight of the toner.

The materials for the toner except for the external additive, are mixed by a mixer such as HENSCHEL MIXER, SUPER-MIXER, MECHANOMILL or a Q-type mixer, and the material mixture thus acquired is melt-kneaded by a kneader such as a biaxial kneader, a uniaxial kneader or a continuous double-roller kneader, at a temperature of about 70 to 180° C., and thereafter cooled and solidified. After the material mixture of the toner that has been melt-kneaded is cooled and solidified, the material mixture is coarsely pulverized by a cutter mill, a feather mill or the like. The material mixture thus pulverized coarsely is subjected to fine pulverization. For the fine pulverization, a jet mill, a fluidized-bed type jet mill or the like is used. Such mills perform pulverization of toner particles by causing air currents including the toner particles to collide with one another in a plurality of directions, thereby causing the toner particles to collide with one another. Whereby, it is possible to produce the nonmagnetic toner base particle that has a specific particle size distribution. The particle size of the toner base particle is not particularly restricted, but the volume average particle size thereof is preferably in a range of 3 to 10 μm. Furthermore, the particle size may be adjusted by classification and the like as necessary. To the toner base particle thus produced, the above-mentioned external additive is added by a known method. Note that, the method for producing the toner is not restricted to the above.

(2) Two-Component Developer

The two-component developer can be manufactured by mixing the toner and the above-mentioned resin-coated carrier 50. A mixing ratio of the toner and the resin-coated carrier 50 is not particularly limited and in consideration of the use thereof in a high-speed image forming apparatus (which forms A4-sized images on 40 sheets or more per minute), it is preferred that a ratio of a total projected area of the toner (a sum of projected areas of all the toner particles) relative to a total surface area of the resin-coated carrier 50 (a sum of surface areas of all the resin-coated carrier particles), that is, ((the total projected area of the toner/the total surface area of the resin-coated carrier 50)×100), is 30% to 70% in a state where a ratio represented by (an average particle size of the resin-coated carrier 50/an average particle size of the toner) is 5 or more. This allows the charging property of the toner to be stably maintained in a sufficiently favorable state, resulting in a favorable two-component developer which can stably form high-quality images for a long period of time even in a high-speed image forming apparatus.

For example, assuming that: the volume average particle size of the toner is set at 6.5 μm; the volume average particle size of the resin-coated carrier 50 is set at 50 μm; and the ratio of the total projected area of the toner relative to the total surface area of the resin-coated carrier 50 is set in a range of 30% to 70%, the two-component developer will contain around 2.2 to 5.3 parts by weight of the toner based on 100 parts by weight of the resin-coated carrier. The high-speed development using the two-component developer as just described leads to the largest amount of toner consumption and the largest amount of toner supply that is supplied to a developing tank of a developing device according to the consumption of toner and toner. The balance of supply and demand will be nevertheless lost. And when the amount of the resin-coated carrier 50 contained in the two-component developer exceeds a value around 2.2 to 5.3 parts by weight, the amount of charges tends to be smaller, thus failing to obtain the desired developing property, and moreover the amount of toner consumption is larger than the amount of toner supply, thus failing to impart sufficient charges to the toner, which causes the deterioration of image quality. Furthermore, when the amount of the resin-coated carrier 50 contained in the developer is small, the amount of charges tends to be larger and thus, the toner is less easily separated from the resin-coated carrier 50 through the electric field, thereby causing the deterioration of image quality.

In the embodiment, the total projected area of the toner was determined as follows. Assuming that specific gravity of the toner was 1.0, the total projected area of the toner was determined based on the volume average particle size obtained by a Coulter counter: COULTER COUNTER MULTISIZER II (trade name, manufactured by Beckman Coulter, Inc.) That is, the number of the toners relative to the weight of the toners to be mixed was counted, and the number of the toners was multiplied by the area of the toners (which was obtained based on the assumption that the area is a circle) to thus obtain a total projected area of the toner. In a similar fashion, a total surface area of the resin-coated carrier 50 was determined from the weight of the resin-coated carriers to be mixed based on the particle size which had been obtained by Microtrac (trade name: Microtrac MT3000, manufactured by NIKKISO CO., LTD.) In this case, specific gravity of the resin-coated carrier 2 was defined as 3.7. Using the values obtained as above, the mixing ratio of the toner and the carrier 50 was determined by (the total projected area of the toner/the total surface area of the resin-coated carrier 50)×100.

3. Developing Device

Figure 2:
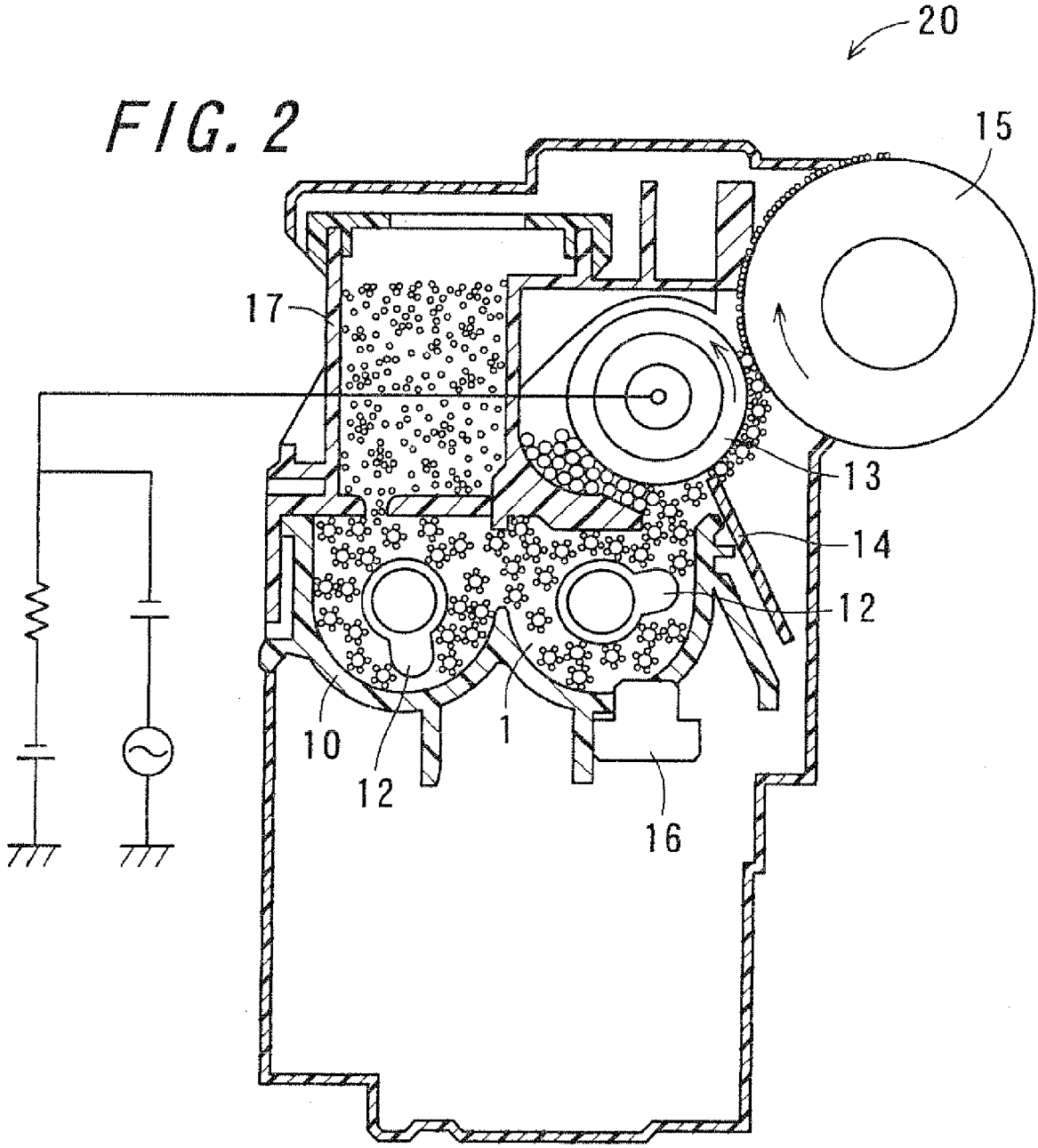
FIG. 2 is a view showing a configuration of a developing device according to one embodiment of the invention.

FIG. 2 is a view showing a configuration of a developing device 20 as an embodiment of the invention. The developing device 20 performs development using the above-mentioned two-component developer 1. As shown in FIG. 2, the developing device 20 includes a developing unit 10 for storing the two-component developer 1 and a developer bearing member (developer conveyance bearing member) 13 for carrying the two-component developer 1 to an image bearing member (photoreceptor) 15.

The two-component developer 1 comprising the resin-coated carrier 50 and the toner, previously introduced into the development unit 10 is stirred by a stirring screw 12, and thereby the two-component developer is charged. The two-component developer 1 is conveyed to the developer bearing member 13 having a magnetic field-generating part (not shown) provided therein, and held on the surface of the developer bearing member 13. The two-component developer 1 held on the surface of the developer bearing member 13 is adjusted to a constant layer thickness by a developer regulating member 14, and conveyed to a development region formed in an adjacent region between the developer bearing member 13 and the image bearing member 15. By applying alternate current bias to the two-component developer 1 conveyed up to the development region, electrostatic charge image on the image bearing member 15 is developed by a reversal development method, and a visible image is formed on the image bearing member 15.

The toner consumption resulting from formation of a visible image is detected by a toner density sensor 16 as variations in a toner density that is a weight ratio of the toner relative to the two-component developer, and the amount consumed is replenished from a toner hopper 17 until the toner density sensor 16 detects that the toner density has reached a predetermined specified level, thereby the toner density of the two-component developer 1 in the development unit 10 is maintained substantially at a constant level. Further, in the embodiment, a gap between the developer bearing member 13 and the developer regulating member 14, and a gap between the developer bearing member 13 and the image bearing member 15 in the development region are set, for example, to 0.4 mm. However, this is merely an example, and is therefore not restricted to this value. In this way, the developing device 20 of the embodiment performs development using the two-component developer of the embodiment. As a result, the development can be performed with a toner having stabilized charge amount even though the number of printing is increased, and a toner image having high definition and free of fog can stably be formed over a long period of time.

4. Image Forming Apparatus

An image forming apparatus of the embodiment includes the above-mentioned developing device 20. As other components, components similar to those of a known electrophotographic image forming apparatus are applicable, for example, including an image bearing member, a charging section, an exposure section, a transfer section, a fixing section, an image bearing member cleaning section, and an intermediate transfer member cleaning section. The image bearing member has a photosensitive layer on the surface of which an electrostatic image can be formed. The charging section charges the surface of the image bearing member to a predetermined potential. The exposure section irradiates the image bearing member whose surface is in a charged state with signal light corresponding to image information to form an electrostatic image (electrostatic latent image) on the surface of the image bearing member. The transfer section transfers a toner image on the surface of the image bearing member, which has been developed by the toner supplied from the developing device 20, onto an intermediate transfer member, and then to a recording medium. The fixing section fixes the toner image on the surface of the recoding medium. The image bearing member cleaning section removes toner, paper dust and the like that remain on the surface of the image bearing member after the toner image is transferred to the recording medium. The intermediate transfer member cleaning section removes redundant toner adhering to the intermediate transfer member.

The image forming apparatus of the embodiment includes the above-mentioned developing device 20. The developing device 20 can stably form a toner image with high definition and free of fog over a long period of time. Therefore, even in the image forming apparatus of the embodiment, a high quality image that finely reproduces an image, has good color reproducibility and high image density and is free of image defects such as fog can stably be formed over a long period of time.

EXAMPLES specific descriptions will be given hereinbelow concerning Examples and Comparative examples. The invention is, however, not restricted to the present examples as long as included in a gist of the invention. Hereinafter, "part" refers to "parts by weight". Further, unless otherwise mentioned, "%" refers to "% by weight".

Note that, the apparent density of the carrier core, the area average diameter of the surface fine pores of the carrier core, the volume average particle size of the carrier and the volume average particle size of the toner that were used in Examples and Comparative Examples were measured as follows.

[Apparent Density of Carrier Core]

An apparent density of a carrier core was measured according to JIS Z2504 (2000).

[Area Average Diameter of Surface Fine Pores of Carrier Core]

A photographs of the carrier core before and after adding the cross-linked fine resin particle are taken with the electron microscope (trade name: VE-9500, manufactured by Keyence Corporation) of 1000 times power. A ½ region of radius of the carrier core from the center of the carrier core is then trimmed away from the respective photographs, and the total area of the surface fine pores and the area average diameter of the carrier core are calculated by extracting and analyzing perimeters of the surface fine pores of the carrier core from a region thereof with image analysis software (trade name: A-ZO KUN, manufactured by Asahi Kasei Engineering Corporation). Such analysis is performed for each 50 particles for the carrier core before and after adding the cross-linked fine resin particle, and the average value served as the total area of the surface fine pore and the area average diameter of the carrier core.

[Volume Average Particle Size of Resin-Coated Carrier]

Approximately 10 to 15 mg of a measurement sample was added to a 10 mL solution having 5% EMULGEN 109P (polyoxyethylene lauryl ether HLB 13.6, manufactured by Kao Corporation), the mixture was dispersed by an ultrasonic dispersing device for one minute, and approximately 1 mL of the mixture was added to a predetermined point of Microtrac MT-3000 (manufactured by NIKKISO CO., LTD.) and then stirred for one minute, and thereafter, it was confirmed that the scattered light intensity was stable to perform the measurement.

[Volume Average Particle Size of Toner]

In a 100 mL beaker, 20 mL of an aqueous solution (electrolyte solution) having 1% sodium chloride (primary) was put, and to the solution, 0.5 mL of an alkyl benzene sulfonate (dispersing agent) and 3 mg of a toner sample were successively added, then the mixture was dispersed ultrasonically for 5 minutes. The aqueous solution having 1% sodium chloride (primary) was added to the mixture so that the total amount was 100 mL, the resultant mixture was ultrasonically dispersed for 5 minutes again to thereby obtain a measurement sample. With respect to the measurement sample, the volume average particle size was calculated by COULTER COUNTER TA-III (product name, manufactured by Beckman Coulter, Inc.) under the conditions that the aperture diameter was 100 μm and that the particle size to be measured was 2 to 40 μm for each particle.

Preparation methods of a resin-coated carrier and a toner, contained in the developers used in Examples and Comparative Examples are described below.

Preparation of Resin-Coated Carrier

Example 1

[Weighing Step and Mixing Step]

Finely pulverized $Fe_2O_3$ and $MgCO_3$ were provided as raw materials of a carrier core, weighed so as to be $Fe_2O_3$:$MgCO_3$=80:20 in molar ratio, and mixed to obtain a metal raw material mixture. Polyethylene resin particles (trade name: LE-1080, manufactured by Sumitomo Seika Chemicals Co., Ltd.) having a volume average particle size of 5 μm in an amount corresponding to 5 wt % of all raw materials of a carrier core, an ammonium polycarbonate dispersant in an amount corresponding to 1.5 wt % of all raw materials of a carrier core, SN WET 980 (wetting agent, manufactured by SAN NOPCO LIMITED) in an amount corresponding to 0.05 wt % of all raw materials of a carrier core, and polyvinyl alcohol (binder) in an amount corresponding to 0.02 wt % of all raw material of a carrier core were added to water to prepare an aqueous solution.

[Pulverization Step]

The metal raw material mixture was introduced into the aqueous solution, and stirred to obtain slurry having a concentration of 75 wt %. The slurry was wet-pulverized with a wet ball mill, and stirred for a while until a volume average particle size is 1 μm.

[Granulation Step]

The slurry was sprayed with a spray drier to obtain a dried granulated product having a volume average particle size of from 10 to 200 μm. Coarse particles were separated from the granulated product using a sieve mesh having a mesh size of 61 μm.

[Calcination Step]

The dried granulated product was heated at 900° C. in the atmosphere to calcine the product, thereby decomposing resin particle component. Thus, a calcined product was obtained.

[Firing Step]

The calcined product was fired at 1160° C. for 5 hours in a nitrogen atmosphere to form ferrite. Thus, a fired product was obtained.

[Crushing Step and Classification Step]

The fired product was crushed with a hammer mill, fine powder was removed using a wind power classifier, and a particle size was adjusted with a vibration sieve having a mesh size of 54 μm. Thus, a carrier core C1 was obtained. The obtained carrier core C1 had an apparent density of 1.80 g/cm$^3$ and an area average diameter of the surface fine pores of 0.6 μm.

[Cross-Linked Fine Resin Particle Adding Step]

A weight of the silicone fine resin particles S1 (trade name: Tospearl, manufactured by Momentive Performance Materials Japan LLC) having a volume average particle size of 0.70 μm as the cross-linked fine resin particles was adjusted such that a ratio of the total projected area of the silicone fine resin particles S1 relative to the total surface area of the carrier core C1 ((total projected area of the silicone fine resin particles S1/total surface area of the carrier core C1)×100) is 20%, which were dispersed in 15 parts of toluene by ultrasonic waves, and cross-linked fine resin particle dispersion liquid was obtained.

In the obtained cross-linked fine resin particle dispersion liquid, 100 parts of the carrier core C1 were immersed, and stirred while heating. Thereafter, volatile removal of toluene results in adhesion of the silicone fine resin particles S1 to the surface of the carrier core C1, and the carrier core C1 whose surface fine pores were filled with the silicone fine resin particles S1 was obtained.

At this time, the opened surface fine pore ratio P1 (ratio of the total area of the surface fine pore opened after adding fine particles relative to the total surface area of the carrier core) was 3%.

[Coating Step]

In 15 parts of toluene, 2.0 parts of a cross-linked silicone resin A (trade name: KR240, manufactured by Shin-Etsu Chemical Co., Ltd.) and 2.0 parts of a cross-linked silicone resin B (trade name: KR251, manufactured by Shin-Etsu Chemical Co., Ltd.) were dissolved, into which 0.20 part of conductive particles (trade name: VULCAN XC-72, manufactured by Cabot Corporation) and 0.20 part of a coupling agent (trade name: AY43-059, manufactured by Dow Corning Toray Co., Ltd.) were added and dispersed, whereby a coating resin solution was prepared. By using 19.4 parts of the coating resin solution, the surface of the carrier core C1 whose surface fine pores were filled with the silicone fine resin particles S1 was coated by an immersion method. Subsequently, through a cure process at cure temperature of 200° C. and for cure time of 1 hour, the resin-coated carrier of Example 1 was obtained by passing through a 150 μm-mesh sieve. The obtained resin-coated carrier of Example 1 had a volume average particle size of 45 μm.

Example 2

The resin-coated carrier of Example 2 was obtained in the same manner as Example 1, except that an addition amount of the polyethylene resin particles to all raw materials of the carrier core was changed from 5 wt % to 0.5 wt % at the mixing step. The carrier core C2 of the resin-coated carrier of Example 2 had an apparent density of 1.98 g/cm$^3$ and an area average diameter of the surface fine pores of 0.42 μm.

At this time, the opened surface fine pore ratio P1 (ratio of the total area of the surface fine pores opened after adding fine particles relative to the total surface area of the carrier core) was 2%. Further, the resin-coated carrier of Example 2 had a volume average particle size of 45 μm.

Example 3

The resin-coated carrier of Example 3 was obtained in the same manner as Example 1, except that an addition amount of the polyethylene resin particles to all raw materials of the carrier core was changed from 5 wt % to 15 wt % at the mixing step. The carrier core C3 of the resin-coated carrier of Example 3 had an apparent density of 1.62 g/cm$^3$ and an area average diameter of the surface fine pores of 0.67 μm.

At this time, the opened surface fine pore ratio P1 (ratio of the total area of the surface fine pores opened after adding fine particles relative to the total surface area of the carrier core) was 4%. Further, the resin-coated carrier of Example 3 had a volume average particle size of 45 μm.

Example 4

The resin-coated carrier of Example 4 was obtained in the same manner as Example 1, except that the conductive particles were not added in the coating resin solution at the coating step. The carrier core C4 of the resin-coated carrier of Example 4 had an apparent density of 1.80 g/cm$^3$ and an area average diameter of the surface fine pores of 0.60 μm.

At this time, the opened surface fine pore ratio P1 (ratio of the total area of the surface fine pores opened after adding fine particles relative to the total surface area of the carrier core) was 4%. Further, the resin-coated carrier of Example 4 had a volume average particle size of 45 μm.

Example 5

The resin-coated carrier of Example 5 was obtained in the same manner as Example 1, except that a condition of the granulating step was changed. The carrier core C5 of the resin-coated carrier of Example 5 had an apparent density of 1.83 g/cm$^3$ and an area average diameter of the surface fine pores of 0.61 μm.

At this time, the opened surface fine pore ratio P1 (ratio of the total area of the surface fine pores opened after adding fine particles relative to the total surface area of the carrier core) was 4%. Further, the resin-coated carrier of Example 5 had a volume average particle size of 25 μm.

Example 6

The resin-coated carrier of Example 6 was obtained in the same manner as Example 1, except that a condition of the granulating step was changed. The carrier core C6 of the resin-coated carrier of Example 6 had an apparent density of 1.79 g/cm$^3$ and an area average diameter of the surface fine pores of 0.59 μm.

At this time, the opened surface fine pore ratio P1 (ratio of the total area of the surface fine pores opened after adding fine particles relative to the total surface area of the carrier core) was 3%. Further, the resin-coated carrier of Example 6 had a volume average particle size of 50 μm.

Example 7

The resin-coated carrier of Example 7 was obtained in the same manner as Example 1, except that a condition of the granulating step was changed. The carrier core C7 of the resin-coated carrier of Example 7 had an apparent density of 1.78 g/cm$^3$ and an area average diameter of the surface fine pores of 0.58 μm.

At this time, the opened surface fine pore ratio P1 (ratio of the total area of the surface fine pores opened after adding fine particles relative to the total surface area of the carrier core) was 3%. Further, the resin-coated carrier of Example 7 had a volume average particle size of 55 μm.

Example 8

The resin-coated carrier of Example 8 was obtained in the same manner as Example 1, except that a condition of the granulating step was changed. The carrier core C8 of the resin-coated carrier of Example 8 had an apparent density of 1.75 g/cm$^3$ and an area average diameter of the surface fine pores of 0.62 μm.

At this time, the opened surface fine pore ratio P1 (ratio of the total area of the surface fine pores opened after adding fine particles relative to the total surface area of the carrier core) was 3%. Further, the resin-coated carrier of Example 8 had a volume average particle size of 20 μm.

Example 9

The resin-coated carrier of Example 9 was obtained in the same manner as Example 1, except that an addition amount of the polyethylene resin particles to all raw materials of the carrier core was changed from 5 wt % to 0.5 wt % and the cross-linked fine resin particles were changed to melamine fine resin particles (trade name: EPOSTAR, manufactured by Nippon Shokubai Co., Ltd.) having a volume average particle size of 0.5 μm at the mixing step. The carrier core C9 of the resin-coated carrier of Example 9 had an apparent density of 1.98 g/cm$^3$ and an area average diameter of the surface fine pores of 0.42 μm.

At this time, the opened surface fine pore ratio P1 (ratio of the total area of the surface fine pores opened after adding fine particles relative to the total surface area of the carrier core) was 1%. Further, the resin-coated carrier of Example 9 had a volume average particle size of 45 μm.

Example 10

The resin-coated carrier of Example 10 was obtained in the same manner as Example 1, except that an addition amount of the polyethylene resin particles to all raw materials of the carrier core was changed from 5 wt % to 0.5 wt % and that the weight was adjusted such that the ratio of the total projected area of the silicone fine resin particles relative to the total surface area of the carrier core ((total projected area of the silicone fine resin particles/total surface area of the carrier core)×100) is 10% at the mixing step. The carrier core C10 of the resin-coated carrier of Example 10 had an apparent density of 1.98 g/cm$^3$ and an area average diameter of the surface fine pores of 0.42 μm.

At this time, the opened surface fine pore ratio P1 (ratio of the total area of the surface fine pores opened after adding fine particles relative to the total surface area of the carrier core) was 3%. Further, the resin-coated carrier of Example 10 had a volume average particle size of 45 μm.

Example 11

The resin-coated carrier of Example 11 was obtained in the same manner as Example 1, except that an addition amount of the polyethylene resin particles to all raw materials of the carrier core was changed from 5 wt % to 0.5 wt % and that the weight was adjusted such that the ratio of the total projected area of the silicone fine resin particles relative to the total surface area of the carrier core ((total projected area of the silicone fine resin particles/total surface area of the carrier core)×100) is 5% at the mixing step. The carrier core C11 of the resin-coated carrier of Example 11 had an apparent density of 1.98 g/cm$^3$ and an area average diameter of the surface fine pores of 0.42 μm.

At this time, the opened surface fine pore ratio P1 (ratio of the total area of the surface fine pores opened after adding fine particles relative to the total surface area of the carrier core) was 5%. Further, the resin-coated carrier of Example 11 had a volume average particle size of 45 μm.

Example 12

The resin-coated carrier of Example 12 was obtained in the same manner as Example 1, except that an addition amount of the polyethylene resin particles to all raw materials of the carrier core was changed from 5 wt % to 15 wt % and that the weight was adjusted such that the ratio of the total projected area of the silicone fine resin particles relative to the total surface area of the carrier core ((total projected area of the silicone fine resin particles/total surface area of the carrier core)×100) is 30% at the mixing step. The carrier core C12 of the resin-coated carrier of Example 12 had an apparent density of 1.62 g/cm$^3$ and an area average diameter of the surface fine pores of 0.67 μm.

At this time, the opened surface fine pore ratio P1 (ratio of the total area of the surface fine pores opened after adding fine particles relative to the total surface area of the carrier core) was 2%. Further, the resin-coated carrier of Example 12 had a volume average particle size of 45 μm.

Example 13

The resin-coated carrier of Example 13 was obtained in the same manner as Example 1, except that an addition amount of the polyethylene resin particles to all raw materials of the carrier core was changed from 5 wt % to 15 wt % and that the weight was adjusted such that the ratio of the total projected area of the silicone fine resin particles relative to the total surface area of the carrier core ((total projected area of the silicone fine resin particles/total surface area of the carrier core)×100) is 35% at the mixing step. The carrier core C13 of the resin-coated carrier of Example 13 had an apparent density of 1.62 g/cm$^3$ and an area average diameter of the surface fine pores of 0.67 μm.

At this time, the opened surface fine pore ratio P1 (ratio of the total area of the surface fine pores opened after adding fine particles relative to the total surface area of the carrier core) was 4%. Further, the resin-coated carrier of Example 13 had a volume average particle size of 45 μm.

Comparative Example 1

The resin-coated carrier of Comparative Example 1 was obtained in the same manner as Example 1, except that the polyethylene resin particles were not added at the mixing step and that the calcination step was not performed. The carrier core C14 of the resin-coated carrier of Comparative Example 1 had an apparent density of 2.15 g/cm$^3$ and an area average diameter of the surface fine pores of 0.35 μm.

At this time, the opened surface fine pore ratio P1 (ratio of the total area of the surface fine pores opened after adding fine particles relative to the total surface area of the carrier core) was 4%. Further, the resin-coated carrier of Example 2 had a volume average particle size of 45 μm.

Comparative Example 2

The resin-coated carrier of Comparative Example 2 was obtained in the same manner as Example 1, except that an addition amount of the polyethylene resin particles to all raw materials of the carrier core was changed from 5 wt % to 25 wt % at the mixing step. The carrier core C15 of the resin-coated carrier of Comparative Example 2 had an apparent density of 1.51 g/cm$^3$ and an area average diameter of the surface fine pores of 0.75 μm.

At this time, the opened surface fine pore ratio P1 (ratio of the total area of the surface fine pores opened after adding fine particles relative to the total surface area of the carrier core) was 10%. Further, the resin-coated carrier of Comparative Example 2 had a volume average particle size of 45 μm.

Preparation of Toner

By a Henschel mixer, 87.5 parts by weight of a polyester resin (trade name: FC1494, manufactured by Mitsubishi Rayon Co., Ltd.) as a binder resin, 5 parts by weight of C. I. Pigment Red 57:1 as a colorant, 6 parts by weight of a release agent (trade name: HNP11, manufactured by Nippon Seiro Co., Ltd.), 1.5 parts by weight of a charge control agent (trade name: LR-147, manufactured by Japan Carlit Co., Ltd.) were pre-mixed, and thereafter melt-kneading was conducted by a twin-screw extruder to obtain a melt-kneaded material.

The melt-kneaded material was coarsely pulverized by a cutting mill, then finely pulverized by a jet mill and classified by a wind power classifier, and toner base particles having a volume average particle size of 6.5 μm was thereby prepared. Next, to 97.8% by weight of the classified toner base particles, added were 1.2% by weight of silica with a primary particle size of 0.1 μm subjected to a hydrophobization treatment with i-butyltrimethoxysilane and 1.0% by weight of the silica fine particle with a primary particle size of 12 nm subjected to a hydrophobization treatment with HMDS, they were mixed by a Henschel mixer, and the admixture was subjected to an external addition treatment. Thus a negatively charged magenta toner non-magnetic magenta toner) was prepared.

Preparation of Two-Component Developer

In a weight ratio such that a ratio of the total projected area of the toner relative to the total surface area of the resin-coated carrier is 70%, the resin-coated carrier of the Examples and the Comparative Examples and the toner were inputted into a resin cylindrical container, and then mixed and stirred on a double-shaft drive rotating platform for plastic bottles under conditions of rotating speed at 200 rpm for hour. Thus a two-component developer was prepared.

Evaluation

The following evaluations were conducted using the two-component developer.

[Charging Rise Characteristics]

By a rotary cultivator, 5 ml glass bottles containing the two-component developer respectively were stirred at 32 rpm for 1 minute, then the two-component developer was obtained, and a charge amount was measured by a suction type charge amount measuring device (trade name: 210H-2A Q/M Meter, manufactured by TREK INC.). Moreover, after stirring for 3 minutes, a charge amount was measured similarly. Evaluation standards of charging rise characteristics are as follows.

Good: Favorable. The difference between a charge amount after 1 minute and a charge amount after 3 minutes is 5 μC/g or less in absolute value.

Not bad: Fair. The difference between the charge amount after 1 minute and the charge amount after 3 minutes exceeds 5 μC/g and is 7 μC/g or less in absolute value.

Poor: No good. The difference between the charge amount after 1 minute and the charge amount after 3 minutes is larger than 7 μC/g.

[Life Characteristics]

The two-component developer was set in a copier (trade name: MX-3600FN, color printing speed of 36 ppm, monochrome printing speed of 36 ppm, manufactured by Sharp Corporation) which photocopied 50,000 (50K) sheets of an image whose coverage is 5% at normal temperature and normal humidity, and then an image density in an image area, whiteness in a non-image area, and a charge amount of the two-component developer were measured. The image density was measured by X-Rite938 spectrodensitometer. As for the whiteness, tristimulus values X, Y, and Z were obtained by using SZ90 spectral color difference meter manufactured by Nippon Denshoku Industries Co., Ltd.

Evaluation standards of image density are as follows.

Good: Favorable. The image density is 1.4 or more.

Not bad: Fair. The image density is 1.3 or more and less than 1.4.

Poor: No good. The image density is less than 1.3.

Evaluation standards of whiteness are as follows.

Good: Favorable. The Z value is 0.5 or less.

Not bad: Fair. The Z value exceeds 0.5 and is 0.7 or less.

Poor: No good. The Z value exceeds 0.7.

Evaluation standards of charging stability of the two-component developer are as follows.

Good: Favorable. The difference between a charge amount at an initial period and a charge amount after 50K is 3 μC/g or less in absolute value.

Not bad: Fair. The difference between the charge amount at the initial period and the charge amount after 50K exceeds 3 μC/g and 5 μC/g or less in absolute value.

Poor: No good. The difference between the charge amount at the initial period and the charge amount after 50K is larger than 5 μC/g.

[Torque Measurement]

Using the two-component developer in a developing tank of the copier (trade name: MX-3600FN, color printing speed of 36 ppm, monochrome printing speed of 36 ppm, manufactured by Sharp Corporation), torque was measured. Evaluation standards of torque are as follows.

Good: Favorable. The torque value is 11.5 g·cm or less.

Not bad: Fair. The torque value exceeds 11.5 g·cm and is 12.5 g·cm or less.

Poor: No good. The torque value exceeds 12.5 g·cm.

[Carrier Attachment]

Each of two-component developers was set in a copier (trade name: MX-3600FN, color printing speed of 36 ppm and monochrome printing speed of 36 ppm, manufactured by Sharp Corporation), and the number of carriers attached in a constant area (297 mm×24 mm) of a non-image region on the image bearing member was obtained. When obtaining the number of carriers attached, a DC bias voltage applied to the developer bearing member was 200 V, an AC bias voltage was 400 V, a frequency was 9 kHz and the surface of the image bearing member was not charged. Evaluation standards of carrier attachment are as follows.

Good: Favorable. The number of carriers attached is less than 15.

Not bad: Fair. The number of carriers attached is 15 or more and 20 or less.

Poor: No good. The number of carriers attached is greater than 20.

[Graininess]

Each of two-component developers was set in a copier (trade name: MX-3600FN, color printing speed of 36 ppm and monochrome printing speed of 36 ppm, manufactured by Sharp Corporation), and a test chart of the image was printed to measure score values of graininess with color differences from white color of 30, 50, and 70 by using an automatic printer image quality evaluation system (trade name: APQS, manufactured by Oji Scientific Instruments). The lower score value of the graininess shows that the image has less unevenness and is of high quality. Evaluation standards of graininess are as follows.

Good: Favorable. The maximum value of the respective score values of color difference is less than 11500.

Not bad: Fair. The maximum value of the respective score values of color difference is 11500 or more and 12000 or less.

Poor: No good. The maximum value of the respective score values of color difference is greater than 12000.

Comprehensive Evaluation

Evaluation standards of the comprehensive evaluation using the above evaluation results are as follows.

Excellent: All evaluation results of the above evaluations are "Good".

Good: The evaluation results of the above evaluations include "Not bad", but do not include "Poor".

Poor: The evaluation results of the above evaluations include "Poor".

Table 1 shows the evaluation results.

TABLE 1

| Resin-coated carrier | | | | | | | | | | | | | |
|---|---|---|---|---|---|---|---|---|---|---|---|---|---|
| | Carrier core | | Cross-linked fine resin particle | | Opened | Fine | Volume | | | | Life characteristics | | |
| | | Area average | | Volume | surface | Resin | average | | | | | | |
| | | diameter of | | average | fine | particle | particle | Charging rise characteristics | | | Charging stability | | |
| Type | Apparent density ($g/cm^3$) | surface fine pores Rb (μm) | Type | particle size Ra (μm) | pore ratio (%) | additive ratio (%) | size as carrier (μm) | After 1 minute (-μC/g) | After 3 minutes (-μC/g) | Evaluation | Initial period (-μC/g) | After 50 K (-μC/g) | Evaluation |
| Example 1 | 1.80 | 0.60 | Silicone fine resin particle | 0.70 | 3 | 20 | 45 | 27 | 30 | Good | 32 | 30 | Good |
| Example 2 | 1.98 | 0.42 | Silicone fine resin particle | 0.70 | 2 | 20 | 45 | 28 | 31 | Good | 34 | 30 | Not bad |
| Example 3 | 1.62 | 0.67 | Silicone fine resin particle | 0.70 | 4 | 20 | 45 | 25 | 29 | Good | 31 | 30 | Good |
| Example 4 | 1.80 | 0.60 | Silicone fine resin particle | 0.70 | 4 | 20 | 45 | 24 | 30 | Not bad | 30 | 28 | Good |
| Example 5 | 1.83 | 0.61 | Silicone fine resin particle | 0.70 | 4 | 20 | 25 | 25 | 29 | Good | 33 | 30 | Good |
| Example 6 | 1.79 | 0.59 | Silicone fine resin particle | 0.70 | 3 | 20 | 50 | 28 | 30 | Good | 31 | 29 | Good |
| Example 7 | 1.78 | 0.58 | Silicone fine resin particle | 0.70 | 3 | 20 | 55 | 29 | 31 | Good | 32 | 30 | Good |
| Example 8 | 1.75 | 0.62 | Silicone fine resin particle | 0.70 | 3 | 20 | 20 | 25 | 29 | Good | 34 | 31 | Good |
| Example 9 | 1.98 | 0.42 | Melamine fine resin particle | 0.50 | 1 | 20 | 45 | 33 | 35 | Good | 40 | 36 | Not bad |
| Example 10 | 1.98 | 0.42 | Silicone fine resin particle | 0.70 | 3 | 10 | 45 | 27 | 30 | Good | 32 | 28 | Not bad |
| Example 11 | 1.98 | 0.42 | Silicone fine resin particle | 0.70 | 5 | 5 | 45 | 26 | 29 | Good | 31 | 27 | Not bad |
| Example 12 | 1.62 | 0.67 | Silicone fine resin particle | 0.70 | 2 | 30 | 45 | 26 | 28 | Good | 33 | 32 | Good |
| Example 13 | 1.62 | 0.67 | Silicone fine resin particle | 0.70 | 4 | 35 | 45 | 27 | 29 | Good | 35 | 33 | Good |
| Comparative Example 1 | 2.15 | 0.35 | Silicone fine resin particle | 0.70 | 4 | 20 | 45 | 29 | 31 | Good | 33 | 27 | Poor |
| Comparative Example 2 | 1.51 | 0.75 | Silicone fine resin particle | 0.70 | 10 | 20 | 45 | 24 | 29 | Good | 29 | 20 | Poor |

TABLE 1-continued

| Resin-coated carrier | Life characteristics | | | | | | Carrier adhesion | | | | |
|---|---|---|---|---|---|---|---|---|---|---|---|
| | Image density | | Whiteness | | Torque measurement | | | | Graininess | | Comprehensive |
| Type | Density | Evaluation | Z value | Evaluation | Torque value (g.cm) | Evaluation | Number of adhesion (number of pieces) | Evaluation | Score value | Evaluation | Evaluation |
| Example 1 | 1.5 | Good | 0.3 | Good | 11.0 | Good | 12 | Good | 11300 | Good | Excellent |
| Example 2 | 1.5 | Good | 0.2 | Good | 12.1 | Not bad | 9 | Good | 11350 | Good | Good |
| Example 3 | 1.4 | Good | 0.3 | Good | 10.6 | Good | 17 | Not bad | 11250 | Good | Good |
| Example 4 | 1.5 | Good | 0.4 | Good | 11.0 | Good | 11 | Good | 11350 | Good | Good |
| Example 5 | 1.5 | Good | 0.3 | Good | 11.2 | Good | 14 | Good | 11200 | Good | Excellent |
| Example 6 | 1.5 | Good | 0.3 | Good | 10.8 | Good | 9 | Good | 11450 | Good | Excellent |
| Example 7 | 1.4 | Good | 0.3 | Good | 10.7 | Good | 7 | Good | 11550 | Not bad | Good |
| Example 8 | 1.5 | Good | 0.3 | Good | 11.2 | Good | 19 | Not bad | 11150 | Good | Good |
| Example 9 | 1.3 | Not bad | 0.3 | Good | 11.9 | Good | 10 | Good | 11300 | Good | Good |
| Example 10 | 1.5 | Good | 0.3 | Good | 12.2 | Not bad | 14 | Good | 11350 | Good | Good |
| Example 11 | 1.5 | Good | 0.3 | Good | 12.3 | Not bad | 17 | Not bad | 11350 | Good | Good |
| Example 12 | 1.5 | Good | 0.3 | Good | 10.6 | Good | 14 | Good | 11250 | Good | Excellent |
| Example 13 | 1.5 | Good | 0.3 | Good | 10.5 | Good | 19 | Not bad | 11250 | Good | Good |
| Comparative Example 1 | 1.3 | Not bad | 0.6 | Not bad | 12.9 | Poor | 7 | Good | 11450 | Good | Poor |
| Comparative Example 2 | 1.3 | Not bad | 0.7 | Not bad | 10.5 | Good | 25 | Poor | 11300 | Good | Poor |

From Table 1, it is found that the resin-coated carrier in Examples 1 to 13 in which the apparent density of the carrier core is 1.6 to 2.0 g/cm$^3$, the volume average particle size of the silicone fine resin particles contained in the resin coating layer and the area average diameter of the surface fine pores of the carrier core have a relation to satisfy the above expression (1), and the silicon fine resin particles are configured so as to fill the surface fine pores of the carrier core, has a favorable evaluation result.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A resin-coated carrier comprising:

a carrier core composed of a porous material having fine pores formed on a surface thereof, and having an apparent density of 1.6 to 2.0 g/cm$^3$; and a resin coating layer formed on a surface of the carrier core, containing cross-linked fine resin particles, the resin-coated carrier satisfying the following expression (1):

$$(Db+0.3\ \mu m)>Da>Db \quad (1),$$

wherein Da (μm) represents a volume average particle size of the cross-linked fine resin particles and Db (μm) represents an area average diameter of the fine pores.

2. The resin-coated carrier of claim 1, wherein the resin coating layer contains a conductive particle.

3. The resin-coated carrier of claim 1, wherein the resin-coated carrier has a volume average particle size of 25 to 50 μm.

4. The resin-coated carrier of claim 1, wherein a silicone fine resin particle is used as the cross-linked fine resin particle.

5. The resin-coated carrier of claim 1, wherein a ratio of a total projected area of the cross-linked fine resin particles relative to a total surface area of the carrier core ((total projected area of the cross-linked fine resin particles/total surface area of the carrier core)×100) is 10 to 30%.

6. A method of manufacturing the resin-coated carrier of claim 1 comprising:

cross-linked fine resin particle adding step of adhering the cross-linked fine resin particles to a surface of the carrier core composed of the porous material having fine pores formed on a surface thereof and having an apparent density of 1.6 to 2.0 g/cm$^3$;

a coating step of forming the resin coating layer over the carrier core and the cross-linked fine resin particles adhered to the surface of the carrier core which are incorporated at the cross-linked fine resin particle adding step, and the carrier core and the cross-linked fine resin particles used at the cross-linked fine resin particle adding step satisfying the expression (1):

$$(Db+0.3\ \mu m)>Da>Db \quad (1),$$

wherein Da (μm) represents a volume average particle size of the cross-linked fine resin particles, and Db (μm) represents an area average diameter of the fine pores.

7. A two-component developer comprising the resin-coated carrier of claim 1 and a toner containing a binder resin and a colorant.

8. A developing device performing development using the two-component developer of claim 7.

9. An image forming apparatus comprising the developing device of claim 8.

* * * * *